US006368139B1

(12) United States Patent
Ohkita et al.

(10) Patent No.: US 6,368,139 B1
(45) Date of Patent: Apr. 9, 2002

(54) ELECTRICAL SOCKET HAVING IMPROVED LATCHING MEANS

(75) Inventors: Masao Ohkita; Yao-Chi Huang; Genn-Sheng Lee, all of Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/013,394

(22) Filed: Dec. 7, 2001

(51) Int. Cl.[7] ..... H01R 4/50
(52) U.S. Cl. ..... 439/342; 439/259
(58) Field of Search ..... 439/342, 259, 439/265, 263, 266, 268

(56) References Cited

U.S. PATENT DOCUMENTS 5,722,848 A * 3/1998 Lai et al. ..... 439/342
5,833,483 A * 11/1998 Lai et al. ..... 439/342
6,042,413 A * 3/2000 Hsaio et al. ..... 439/342
6,065,990 A * 5/2000 McHugh et al. ..... 439/342
6,113,411 A * 9/2000 Lu et al. ..... 439/342
6,152,757 A * 11/2000 Szui ..... 439/342
6,186,816 B1 * 2/2001 Lu et al. ..... 439/342
6,210,196 B1 * 4/2001 Wang et al. ..... 439/342
6,231,367 B1 * 5/2001 Hsiao et al. ..... 439/342
6,243,267 B1 * 6/2001 Chuang ..... 361/704
6,264,490 B1 * 7/2001 Lemke et al. ..... 439/342

* cited by examiner

*Primary Examiner*—Tho D. Ta
*Assistant Examiner*—Phuongchi Nguyen
(74) *Attorney, Agent, or Firm*—Wei Te Chung

(57) ABSTRACT

A CPU socket (1) includes a non-conductive base (10) defining an array of through holes (103), a plurality of conductive contacts (11) retained in corresponding through holes, a movable cover (12) covering the base and an actuator member (13) for moving the cover with respect to the base. The base forms a pair of latching members (140) and each latching member has a body portion (141) and a horn portion (142) which define a first acute angle between. The cover forms a pair of hook members (124) for engaging with the latching members of the base and each hook member has an elongate body (125) and a hook portion (126) which define a second acute angle equal to the first acute angel for fittingly latching the latching member of the base.

9 Claims, 5 Drawing Sheets

ELECTRICAL SOCKET HAVING IMPROVED LATCHING MEANS

BACKGROUND OF THE INVENTION

The present invention relates to an electrical socket, and particularly to a central processing unit (CPU) socket having an improved latching means. CPU sockets are well known in the pertinent art and widely used in computer industry. Thus, the CPU sockets are very competitive in markets and one which has a good performance while maintains low manufacturing cost is undoubted predominate.

A copending U.S. patent application with an unknown Ser. No. filed on Oct. 24, 2001 with a title "BALL GRID ARRAY SOCKET CONNECTOR" and assigned to the same assignee, discloses a CPU socket 8 as shown in FIGS. 6 and 7. The CPU socket 8, named as a zero insertion force (ZIF) pin grid array (PGA) socket, has a non-conductive base 80, a movable cover 81 mounted on the base 80 and an actuator member 83 fastened at one side of the base 80 for moving the cover 81 with respect to the base 80. The base 80 forms a pair of latching members 803 and each latching member 803 has a body portion 804 and a horn portion 805 vertically extending from the body portion 804. The cover 81 has a pair of hook members 811 for hooking the latching members 803 and each latching member 803 has a vertical body 812 and a horizontal hook 814 normal to the vertical body 812 for hooking the horn portion 805 of the base 80. During movement of the cover 81, a normal force F1 generated in the hook portion 814 causes an opening moment M1 with respect to the latching member 803, which results in the cover 81 floating with respect to the base 80. This phenomenon is very disadvantageous because the floating of the cover drives the CPU (not shown) mounted thereon floating also, and thus causes pins of the CPU disconnecting from the conductive contacts (not shown) of the CPU socket 8. One solution is that a backup plate 84 is manufactured and inserted into a space room beside the hook members 811 so as to block the hook members 811 from opening and accordingly prevent the cover 81 from floating with respect to the base 80. However, the backup plate 84 will undoubtedly increase the manufacturing and assembly costs of the electrical socket 8, which is disadvantageous in the competitive market.

Hence, a CPU socket with improved latching means is desired.

BRIEF SUMMARY OF THE INVENTION

A main object of the present invention is to provide a CPU socket having an improved latching means which can ensure reliable connection between the base and the cover thereof while can reduce manufacturing and assembling cost of the CPU socket.

A CPU socket in accordance with the present invention comprises a non-conductive base defining an array of through holes, a plurality of conductive contacts retained in corresponding through holes, a movable cover covering the base and an actuator member for moving the cover with respect to the base. The base defines a shaft slot extending from one lateral side thereof toward a center portion thereof for receiving the actuator member and forms a pair of latching members beside the shaft slot. Each latching member has a body portion and a horn portion inclined and downwardly extending from the body portion and a first acute angle is defined between the body portion and the horn portion. The cover forms a pair of hook members for engaging with the latching members of the base. Each hook member has an elongate body and a hook portion which define a second acute angle equal to the first acute angel for fittedly latching the horn portion of the base.

Other objects, advantages and novel features of the invention will become more apparent from the following detailed description of the present embodiment when taken in conjunction with the accompanying drawings.

DETAILED DESCRIPTION OF THE INVENTION

Reference is now be made to drawing figures for detailed description of the present invention.

Figure 1:
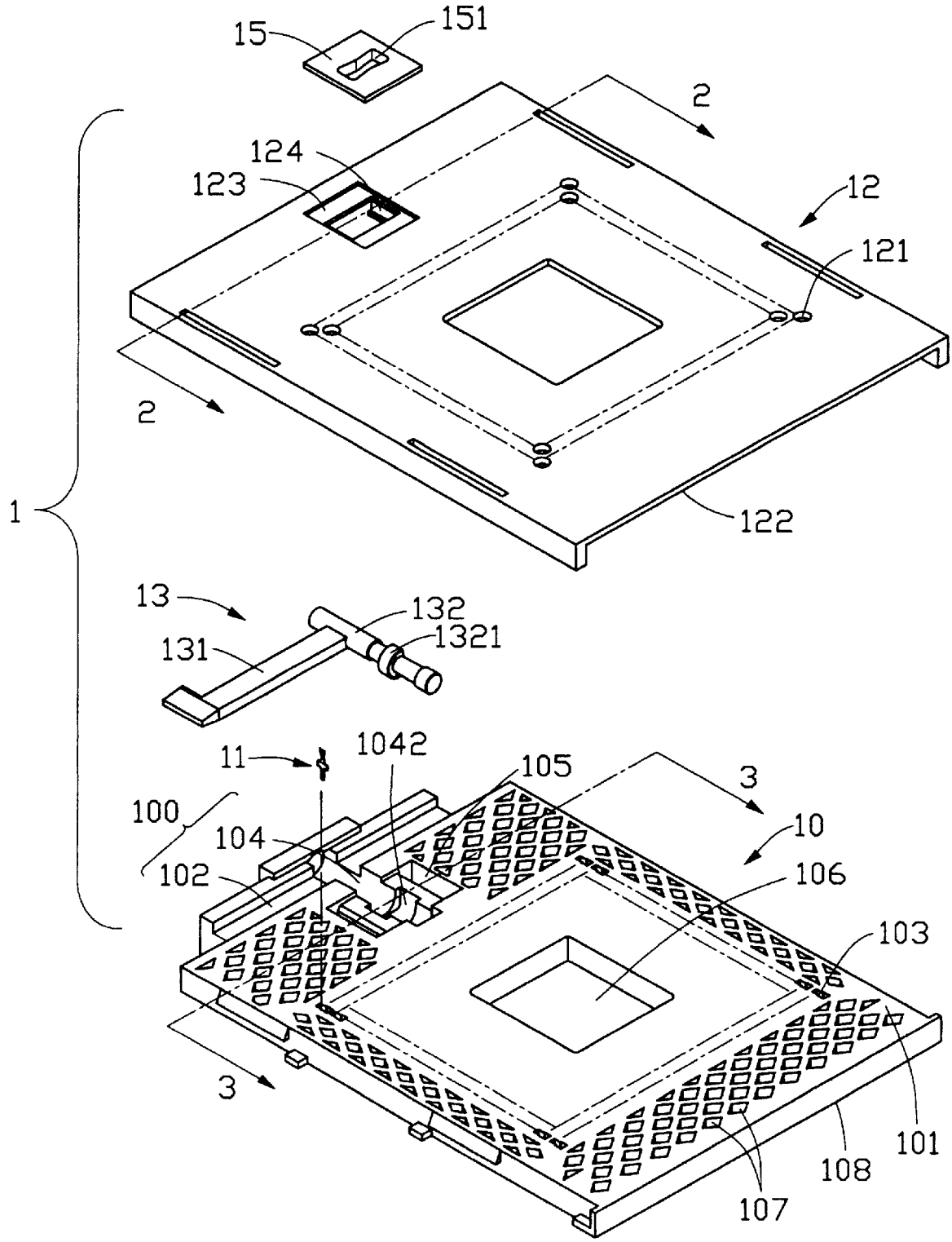
FIG. 1 is an exploded perspective view of a CPU socket in accordance with the present invention.

Referring to FIG. 1 first, an electrical socket 1, named as a ZIF PGA socket in accordance with the present invention is shown in its exploded perspective view. The electrical socket 1 has a rectangular-shaped base 10, a movable cover 12 to be covered the base 10, and an actuator member 13 for moving the movable cover 12 with respect to the base 10.

Figure 3:
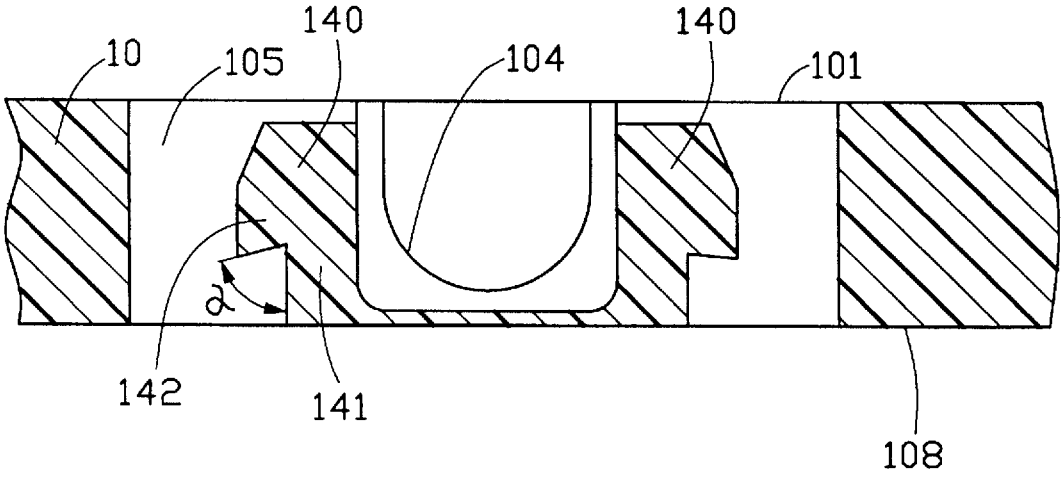
FIG. 3 is a partial enlarged cross-sectional view of a base of the CPU socket taken on line 3—3 of FIG. 1.

Referring to FIGS. 1 and 3, the base 10 defines an array of terminal holes 103 around a central opening 106 thereof for receiving a corresponding number of conductive contacts 11, and an array of through holes 107 further around the terminal holes 103. A substantial "T"-shaped receiving space 100 is defined at one side of the base 10 for receiving the actuator member 13 and has a first slot 102 laterally extending and a second slot 104 normal to and crossing the first slot 102. The second slot 104 extends inside toward the central opening 106 and forms a recessed section 1042 therein. A pair of latching members 140 are formed beside the recessed section 1042 and locates below a top face 101 of the base 10. Each latching member 140 has a body portion 141 and a horn portion 142 inclinedly extending downward from the body portion 141. Thus, the horn portion 142 and the body portion 141 cooperatively define an acute angle $\alpha$ therebetween, and the acute angle $\alpha$ is about 85 degree in the preferred embodiment of the present invention. Additionally, the base 10 further defines a receiving slot 105 outside each latching member 140 and the receiving slot 105 extends through opposite top and bottom surfaces 101, 108 of the base 10.

Figure 2:
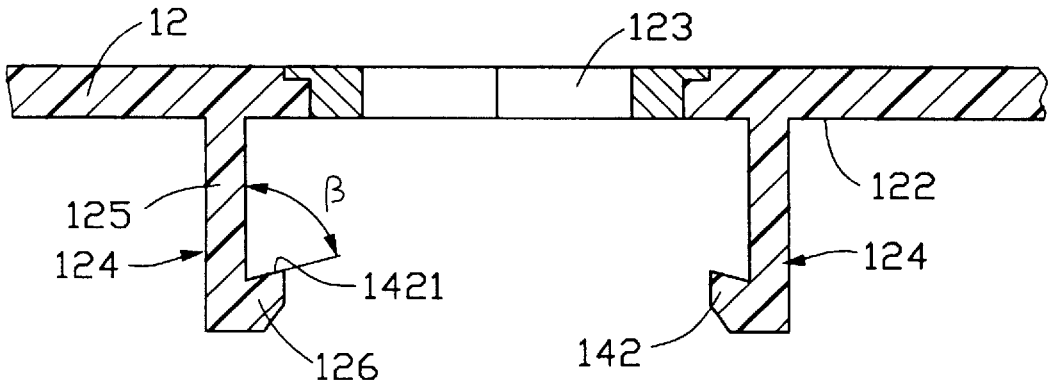
FIG. 2 is a partial enlarged cross-sectional view of a cover of the CPU socket taken on line 2—2 of FIG. 1.

Referring to FIGS. 1 and 2, the movable cover 12 defines an array of pin holes 121 vertically corresponding to the terminal holes 103 of the base 10 for insertion of pins of the CPU (not shown). A through aperture 123 is defined at one side of the cover 12 corresponding to the recessed section 1042 of the second slot 104 of the base 10. Additionally, a pair of hook members 124 depend from a bottom face 122 of the cover 12 for hooking the latching members 140 of the base 10 and each has an elongate body 125 and a horn portion 142 inclinedly and upwardly extending from the elongate body 125 toward the inside of the cover 12. Accordingly, a second acute angle s is defined between the elongate body 125 and the horn portion 142 and is equal to the first acute angle α.

Figure 4:
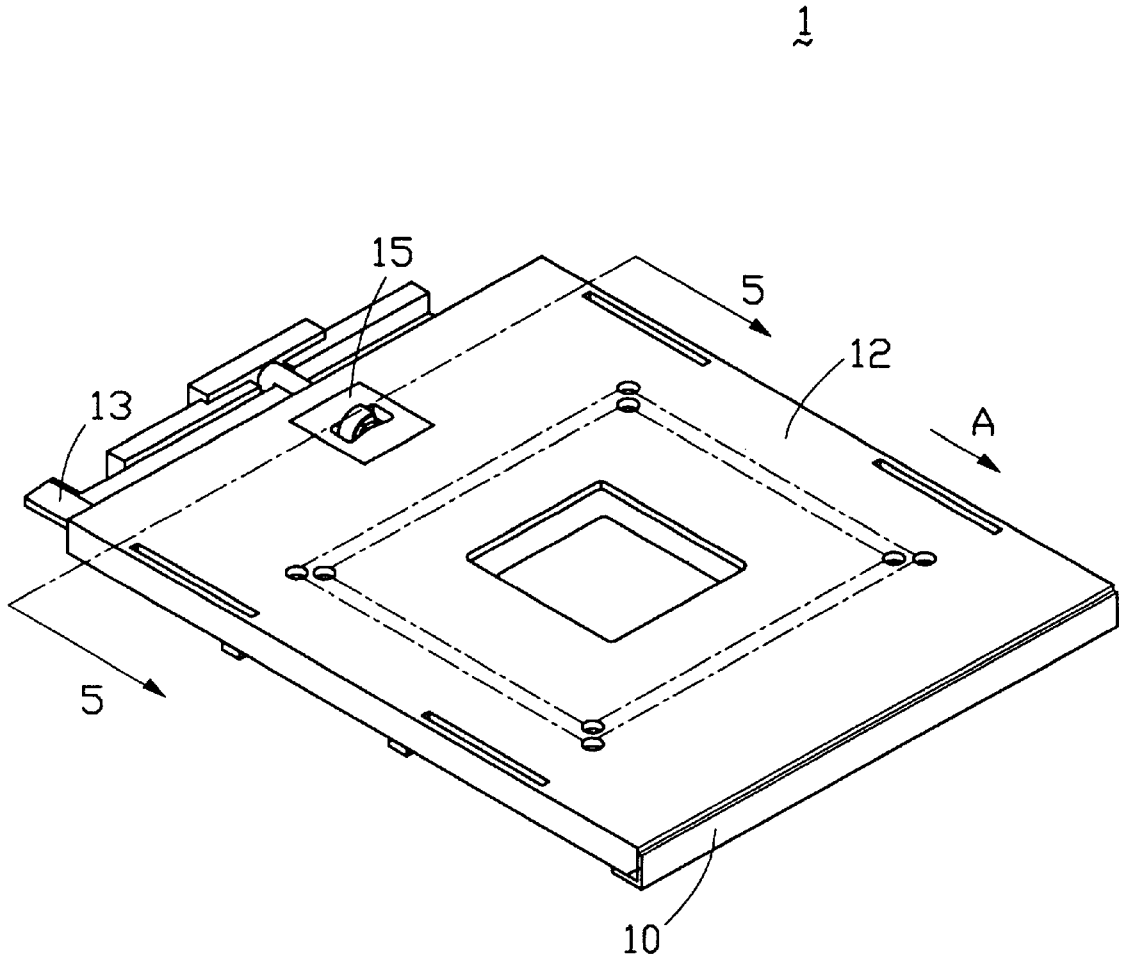
FIG. 4 is an assembled perspective view of FIG. 1.

Further referring to FIGS. 1 and 4, a positioning plate 15 is formed for inserting into the through aperture 123 of the cover 12 and defines an irregular hole 151 in a center portion thereof.

Referring to FIG. 1, the actuator member 13 has a cam shaft 32 and an operating handle 131 vertically extending from the cam shaft 132 for respectively inserting into the second and first slots 104, 102 of the base 10. The cam shaft 132 forms a partial cam portion 1321 to be inserted into the recessed section 1042 of the second slot 104 for moving the cover 12 with respect to the base 10. The operating handle 131 can be pushed to rotate from its horizontal or close position where the pins of the CPU are mechanically and electrically connect with the conductive contacts 11 to its vertical or open position where the pins of the CPU are disconnect from the conductive contacts 11.

Figure 5:
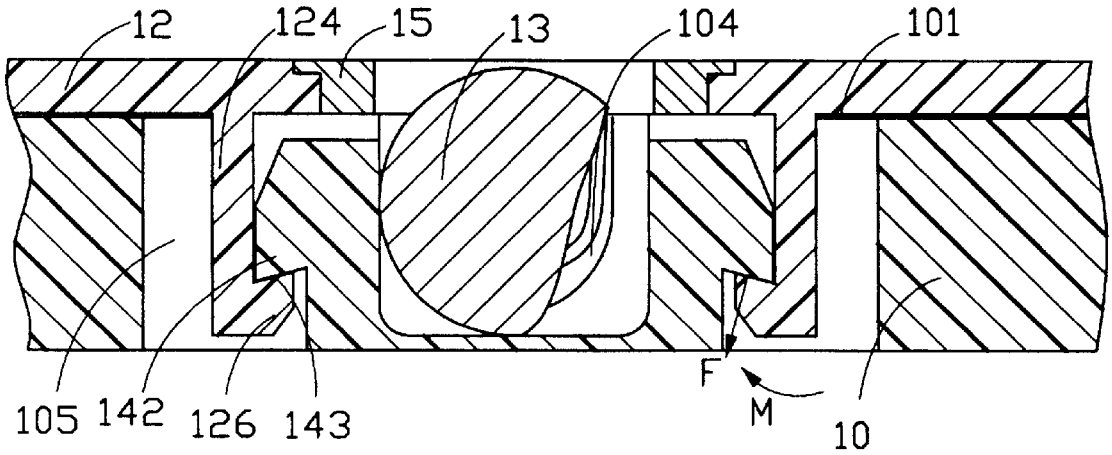
FIG. 5 is a partial enlarged cross-sectional view taken on line 5—5 of FIG. 4.
Figure 6:
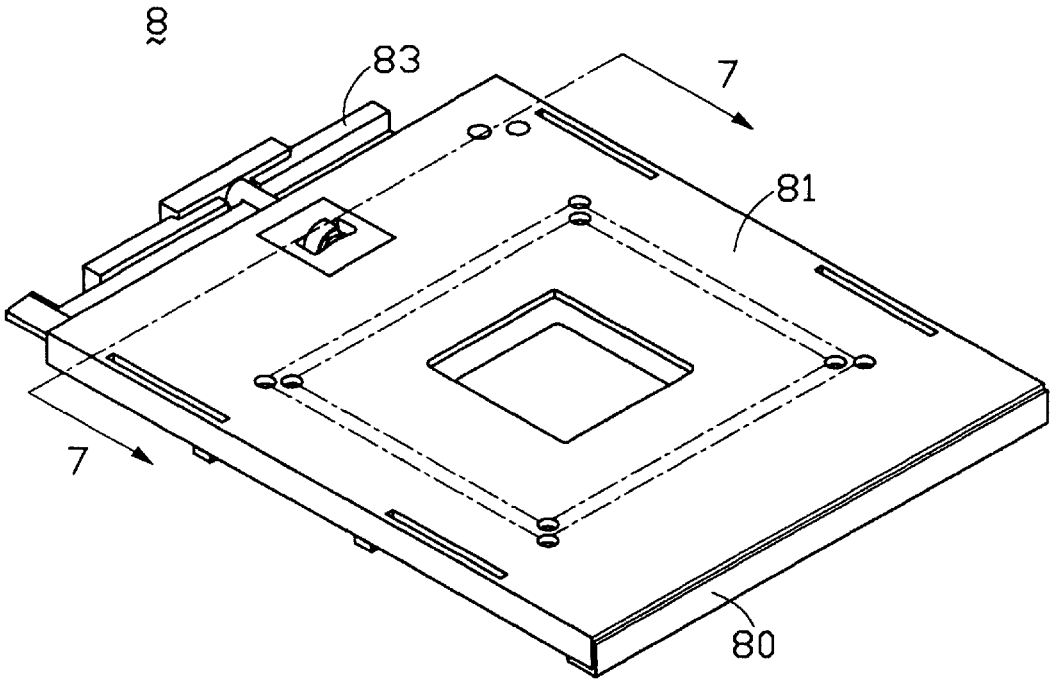
FIG. 6 (PRIOR ART)
FIG. 6 is an assembled perspective view of a conventional CPU socket.
Figure 7:
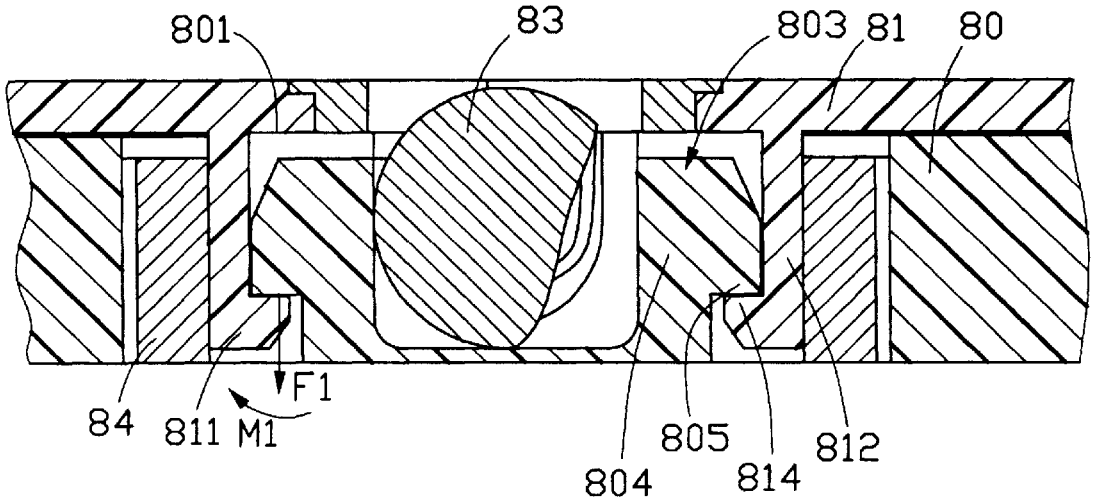
FIG. 7 (PRIOR ART)
FIG. 7 is a partial enlarged cross-sectional view taken on line 7—7 of FIG. 5.

In assembly, referring to FIGS. 1, 4 and 5, the actuator member 13 is fitted into the receiving space 100 of the base 10, that is the cam shaft 132 and the operating handle 131 thereof are inserted into the second and first slots 104, 102, respectively. Meanwhile, the partial cam portion 1321 of the cam shaft 132 is fitted into the recessed section 1042 of the second slot 104. The movable cover 12 is then mounted on the base 10 and the hook members 124 thereof are inserted into corresponding receiving slots 105 of the base 10 to engage with the corresponding latching members 140. As seen in FIG. 5, the hook portion 126 of the hook member 124 abuttedly hooks with the horn portion 142 of the latching member 140, and thus a normal force "F" is generated therein. Finally, the positioning plate 15 is inserted into the through aperture 123 of the cover 12 and the hole 151 thereof partially receives the cam portion 1321 of the actuator member 13. Thus, an assembled electrical socket 1 of the present invention is obtained, as is shown in FIG. 4.

In use, with the operating handle 131 of the actuator member 13 rotating from its horizontal direction to its vertical direction or the adverse, the cover 12 is thus pushed to move horizontally with respect to the base 10 along an "A" direction or the adverse direction "B". With the moving of the cover 12 with respect to the base 10, the hooking members 124 horizontally slide with respect to the corresponding latching members 140. Thus, the normal force F generated in the hook portion 126 of each hook member 124 causes a closing moment M with respect to a corresponding latching portion 142 of the base 10, thereby preventing the cover 12 floating upward with respect to the base 10. Accordingly, the cover 12 can be reliably mounted on the base 10 and a reliable connection between the pins of the CPU and the conductive contacts 11 of the electrical socket 1 can be ensured.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A CPU socket comprising:

a non-conductive base defining an array of through holes and a shaft slot extending from one side toward a center portion thereof, a pair of latching members being formed beside the shaft slot and each having a body portion and a horn portion inclined and downwardly extending from the body portion;

a plurality of conductive contacts being retained in corresponding through holes;

a cover covering on the base and forming a pair of hook members, each hook member having an elongate body and a hook portion inclined and upwardly extending from the elongate body for fittedly latching the horn portion of the base; and an actuator member having a cam shaft received in the shaft slot for moving the cover with respect to the base;

wherein the body portion and the horn poition of the base define a first acute angle therebetween which is about 85 degree;

wherein the elongate body and the hook portion of the cover define a second acute angle equal to the first acute angle;

wherein a normal force generated in each hook member cause a closing moment with respect to a corresponding latching member during movement of the cover.

2. The CPU socket as claimed in claim 1, wherein the base further forms a plurality of through holes around the array of through holes.

3. The CPU socket as claimed in claim 1, wherein the base further defines a channel normal to and communicated with the shaft slot, and wherein the actuator member has an operating handle vertically extending from the cam shaft for insertion into the channel.

4. A socket comprising:

an insulative base with a plurality of contacts therein;

an insulative cover slidably mounted upon the base;

an actuator member mounted in the base with means for actuating the cover to move relative to the base along a front-to-back direction; and interlocking device of said base and said cover formed around the actuator member; wherein said interlocking device performs anti-floating function of the cover relative to the base;

wherein said interlocking device includes a horn portion formed on the base and a hook member formed on the cover;

wherein said horn portion defines a laterally obliquely downwardly configuration, and the hook member defines a laterally obliquely upward configuration complemntary to the configuration of the horn portion.

5. The socket as claimed in claim 4, wherein said horn portion and said hook member are juxtaposed with each other along a lateral direction perpendicular to said front-to-back direction.

6. The socket as claimed in claim 5, wherein the horn portion and the hook member are constantly engaged with each other when said cover is moved with regard to the base along said front-to-back direction.

7. The socket as claimed in claim 5, wherein when said horn portion and said hook member tend to deflectably relatively move along the lateral direction to disengage each other, said mutually complementary configurations of said horn portion and said hook member urge the base and the cover to move toward each other in a vertical direction so as to perform said anti-floating function.

8. The socket as claimed in claim 5, wherein said horn portion is relatively stiff while the hook member is relatively resilient compared with the horn portion.

9. The socket as claimed in claim 5, wherein a space remains beside said hook member along said lateral direction.

* * * * *